US005758843A

United States Patent [19]

Ongaro

[11] Patent Number: 5,758,843

[45] Date of Patent: Jun. 2, 1998

[54] TOILET PAPER HOLDER AND DISBURSEMENT MECHANISM

[76] Inventor: David W. Ongaro, 4 Gordon Pl., Neshanic Station, N.J. 08853

[21] Appl. No.: 821,048

[22] Filed: Mar. 20, 1997

[51] Int. Cl.[6] ..... B65H 16/00; B65H 26/06; B65H 16/06; B65H 18/04

[52] U.S. Cl. ..... 242/565; 242/599.1; 242/599.3; 242/599.4; 242/563.2

[58] Field of Search ..... 242/565, 563.2, 242/564.1, 390.1, 599.1, 599.3, 599.4

[56] References Cited

U.S. PATENT DOCUMENTS 5,467,935 11/1995 Moody ..... 242/565 X

*Primary Examiner*—John Q. Nguyen

[57] ABSTRACT

A toilet paper holder and disbursement mechanism for use with a roll of toilet paper including a spring-loaded rod having ends that are adapted to be fixedly secured to an external mounting bracket; an inner sleeve disposed about the rod and axially aligned therewith and rotatable with respect thereto and having an extended end portion positioned in a plane that is substantially perpendicular to the rod; an elongated outer sleeve for holding a roll of toiler paper, the outer sleeve disposed about the inner sleeve and axially aligned therewith and rotatable with respect thereto and having a extended end portion positioned in a plane that is substantially perpendicular to the rod at a location adjacent to the end portion of the inner sleeve; a spring mechanism coupled between the inner sleeve and outer sleeve for urging the outer sleeve to a fixed rest position relative to the inner sleeve when the outer sleeve is axially rotated and then released; a manually-adjustable payout mechanism coupled between the end portion of the inner sleeve and end portion of the outer sleeve for limiting the rotational movement of the inner sleeve with respect to the outer sleeve; and an engageable latch mechanism coupled to the end portion of the inner sleeve for precluding free movement of the inner sleeve when engaged with the rod and for allowing free movement of the inner sleeve when disengaged.

5 Claims, 4 Drawing Sheets

FIG. 3
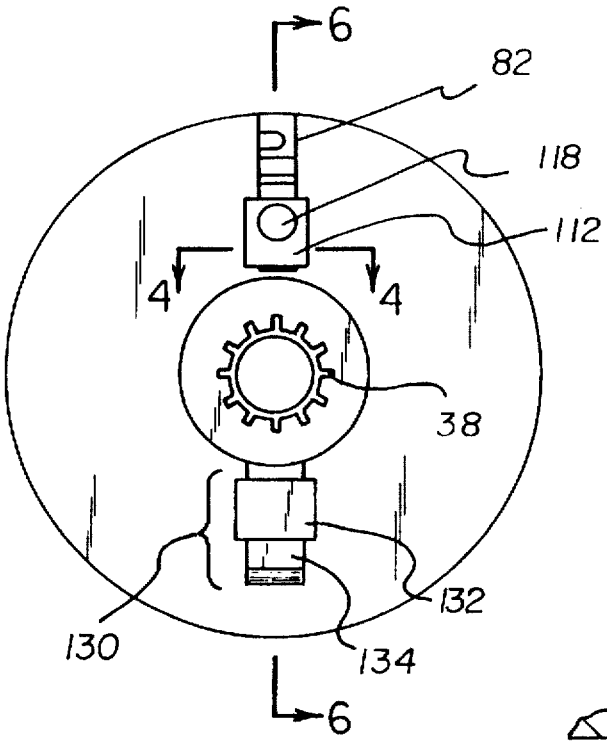
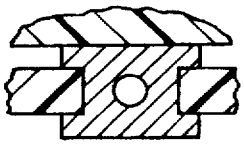
FIG. 4
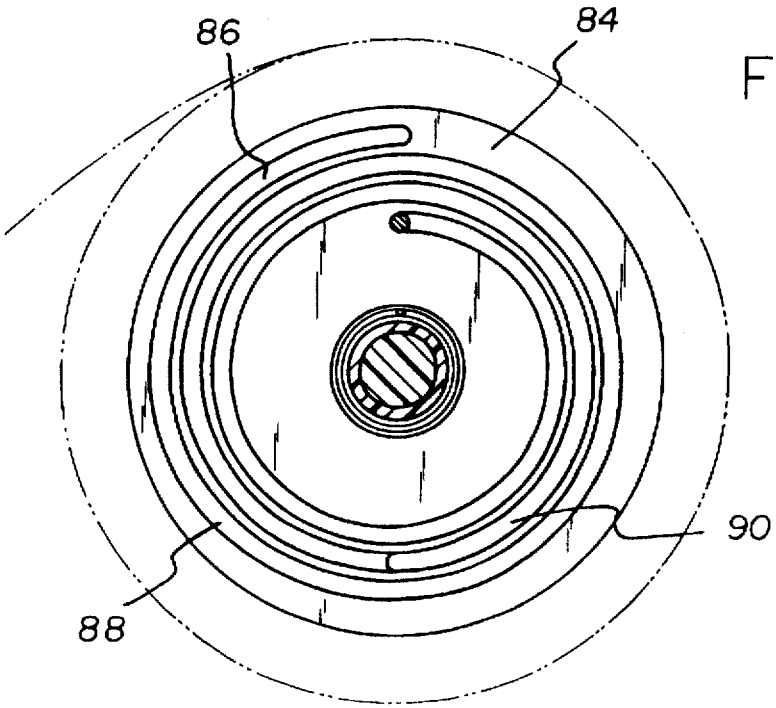
FIG. 5

TOILET PAPER HOLDER AND DISBURSEMENT MECHANISM

BACKGROUND OF THE INVENTION

1. Field of the Invention

The present invention relates to a toilet paper holder and disbursement mechanism and more particularly pertains to disbursing a user-selected amount of toilet paper for use with a toilet paper holder and disbursement mechanism.

2. Description of the Prior Art

The use of toilet paper holders is known in the prior art. More specifically, toilet paper holders heretofore devised and utilized for the purpose of holding and disbursing toilet paper are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,312,021 to Nelson discloses a motorized toilet tissue dispenser. U.S. Pat. No. 5,253,372 to Boker discloses an apparatus for dispensing measured lengths of tubular films onto an armature. U.S. Pat. No. 4,610,407 to Stubbmann discloses a frictional drag arrangement for sheet material dispensers. U.S. Pat. No. 4,285,474 to Perez discloses a toilet paper dispenser with biasing means for restraining the unwinding of the paper. U.S. Pat. No. 4,215,436 to Ketterer discloses a headwear mounted transparent film dispensing means. U.S. Pat. No. Des. 341,739 to Teague discloses a toilet paper holder for attachment to a bedside commode.

While these devices fulfill their respective, particular objective and requirements, the aforementioned patents do not describe a toilet paper holder and disbursement mechanism that allows an adjustable length of toilet paper to be disbursed for use.

In this respect, the toilet paper holder and disbursement mechanism according to the present invention substantially departs from the conventional concepts and designs of the prior art, and in doing so provides an apparatus primarily developed for the purpose of disbursing a user-selected amount of toilet paper for use.

Therefore, it can be appreciated that there exists a continuing need for new and improved toilet paper holder and disbursement mechanism which can be used for disbursing a user-selected amount of toilet paper for use. In this regard, the present invention substantially fulfills this need.

SUMMARY OF THE INVENTION

In the view of the foregoing disadvantages inherent in the known types of toilet paper holders now present in the prior art, the present invention provides an improved toilet paper holder and disbursement mechanism. As such, the general purpose of the present invention, which will be described subsequently in greater detail, is to provide a new and improved toilet paper holder and disbursement mechanism and method which has all the advantages of the prior art and none of the disadvantages.

To attain this, the present invention essentially comprises, in combination, a spring-loaded elongated rod having an elongated tubular first member with an open inboard end and an exterior free outboard end. A notch is disposed on the first member at a location intermediate the ends. A first helical spring is disposed within the first member and in axial alignment therewith. A cylindrical elongated tubular second member is included and slidably inserted within the first member in contact and in axial alignment therewith. The second member has a closed outboard end and a closed and tapered inboard end engaged with an end of the first spring. The first spring urges the members outward. Each outboard free of the rod end is terminated at a cap having a plurality of longitudinal fins extending radially outwards therefrom. Each cap is adapted to be fixedly secured to an external mounting bracket to hold the rod in a fixed position for use.

An elongated inner sleeve is proved and disposed about and in contact with the rod and axially aligned therewith and rotatable with respect thereto. The inner sleeve has an open end, a generally tubular inner intermediate portion, a disk-shaped end portion with a central opening positioned in a plane perpendicular to the inner intermediate portion, an integral flange extending outwards from the end portion, and a notch disposed on the flange. The notch on the inner sleeve is alignable with the notch on the rod.

An elongated outer sleeve is also included and disposed about and in contact with the inner intermediate portion of the inner sleeve and axially aligned therewith and rotatable with respect thereto. The outer sleeve has an open end, a generally tubular outer intermediate portion with a plurality of longitudinal fins extending radially outwards therefrom and adapted for maintaining a grip on an interior surface of the roll of toilet paper, and a disk-shaped end portion with a central opening positioned in a plane perpendicular to the outer intermediate portion at a location in juxtaposition to the end portion of the inner sleeve. The end portion of the outer sleeve also has a radial groove formed thereon and an exterior surface with a helical groove of three turns formed thereon. The helical groove is axially aligned with the rod and the inner sleeve. An outer one and one-half turns of the helical groove has a fixed depth, and an inner one and one-half turns of the groove has a fixed depth greater than the outer one and one-half turns.

A second helical spring is disposed about the inner sleeve between the inner intermediate portion thereof and the outer intermediate portion of the outer sleeve. The second spring has an inboard end coupled to the outer sleeve and an outboard end coupled to the end portion of the inner sleeve. The second spring is used for urging the outer sleeve to a fixed rest position relative to the inner sleeve when the outer sleeve is axially rotated and then released.

Am adjustable pin mechanism is provided and has a radially adjustable clamp slidably secured within the radial groove on the end portion of the outer sleeve, a selector pin coupled to the clamp and having a free end removably securable within the helical groove on the end portion of the outer sleeve, a head end for allowing a user a firm grip, an intermediate portion therebetween having two circumferential and adjacently positioned tapered portions formed thereon, and a spring-loaded detent coupled to the end portion of the outer sleeve and removably engaging the intermediate portion of the selector pin. One of the tapered portions is engagable with the detent when the selector pin is set in one position to define a setting that allows the selector pin to travel only along the outer portion of the helical groove when the outer sleeve is axially rotated. The other tapered portion is engagable with the detent when the selector pin is set in another position to define another setting that allows the selector pin to traverse along both the outer portion and inner portion of the helical groove when the outer sleeve is axially rotated.

Lastly, an adjustable latch is included and slidably coupled to the exterior surface of the end portion of the inner sleeve along a radial line thereof at a position diametrically opposed to the pin mechanism. The latch has an elongated handle with an outer end and a free inner end. The free end is removably positionable within the notch on the inner sleeve and notch on the rod in a first orientation to preclude free movement of the inner sleeve. The free end is also removable from the notches in a second orientation to allow axially rotatable movement of the inner sleeve and outer sleeve as a unit with respect to the rod.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toilet paper holder and disbursement mechanism which has all the advantages of the prior art toilet paper holders and none of the disadvantages.

It is another object of the present invention to provide a new and improved toilet paper holder and disbursement mechanism which may be easily and efficiently manufactured and marketed.

It is a further object of the present invention to provide a new and improved toilet paper holder and disbursement mechanism which is of durable and reliable construction.

An even further object of the present invention is to provide a new and improved toilet paper holder and disbursement mechanism which is susceptible of a low cost of manufacture with regard to both materials and labor, and which accordingly is then susceptible of low prices of sale to the consuming public, thereby making such a toilet paper holder and disbursement mechanism economically available to the buying public.

Still yet another object of the present invention is to provide a new and improved toilet paper holder and disbursement mechanism which provides in the apparatuses and methods of the prior art some of the advantages thereof, while simultaneously overcoming some of the disadvantages normally associated therewith.

Even still another object of the present invention is to provide a new and improved toilet paper holder and disbursement mechanism for disbursing a user-selected amount of toilet paper for use.

Lastly, it is an object of the present invention to provide a new and improved toilet paper holder and disbursement mechanism comprising a spring-loaded elongated rod having free ends that are adapted to be fixedly secured to an external mounting bracket; an elongated inner sleeve disposed about the rod and axially aligned therewith and rotatable with respect thereto and having an extended end portion positioned in a plane that is substantially perpendicular to the rod; an elongated outer sleeve for holding a roll of toilet paper thereon, the outer sleeve disposed about the inner sleeve and axially aligned therewith and rotatable with respect thereto and having a extended end portion positioned in a plane that is substantially perpendicular to the rod at a location adjacent to the end portion of the inner sleeve; a spring mechanism coupled between the inner sleeve and outer sleeve for urging the outer sleeve to a fixed rest position relative to the inner sleeve when the outer sleeve is axially rotated and then released; a manually-adjustable payout mechanism coupled between the end portion of the inner sleeve and end portion of the outer sleeve for limiting the rotational movement of the inner sleeve with respect to the outer sleeve; and an engageable latch mechanism coupled to the end portion of the inner sleeve for precluding free movement of the inner sleeve when engaged with the rod and for allowing free movement of the inner sleeve when disengaged.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is another side-elevational view of the preferred embodiment of the present invention along its axial length.

FIG. 4 is a cross-sectional view of the present invention taken along the line 4—4 of FIG. 3.

FIG. 5 is a cross-sectional view of the present invention taken along the line 5—5 of FIG. 2.

The same reference numerals refer to the same parts through the various Figures.

DESCRIPTION OF THE PREFERRED EMBODIMENT

Figure 1:
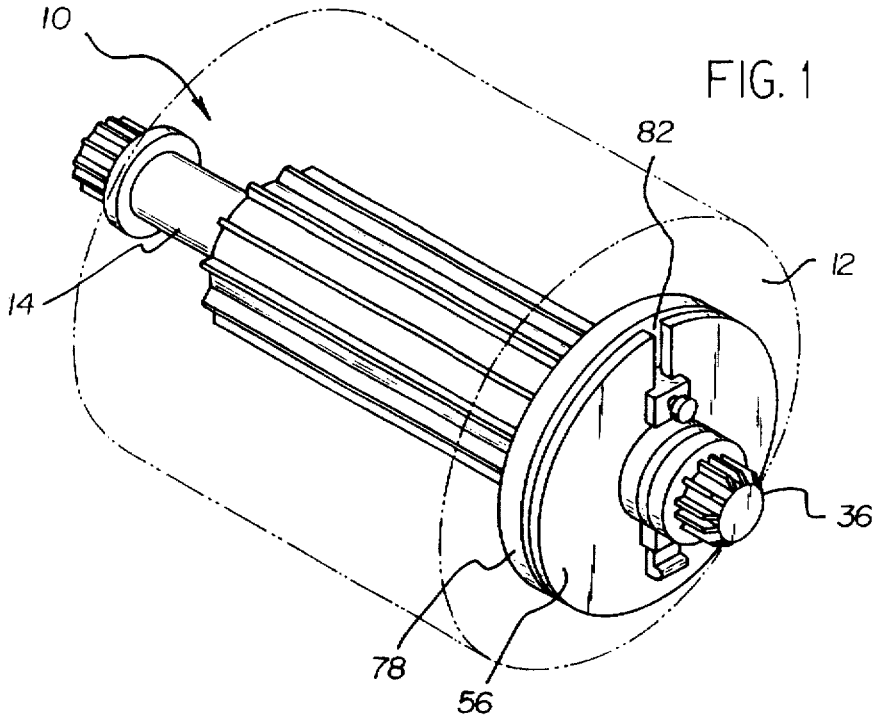
FIG. 1 is a perspective view of the preferred embodiment constructed in accordance with the principles of the present invention removably secured to a roll of toilet paper.
Figure 2:
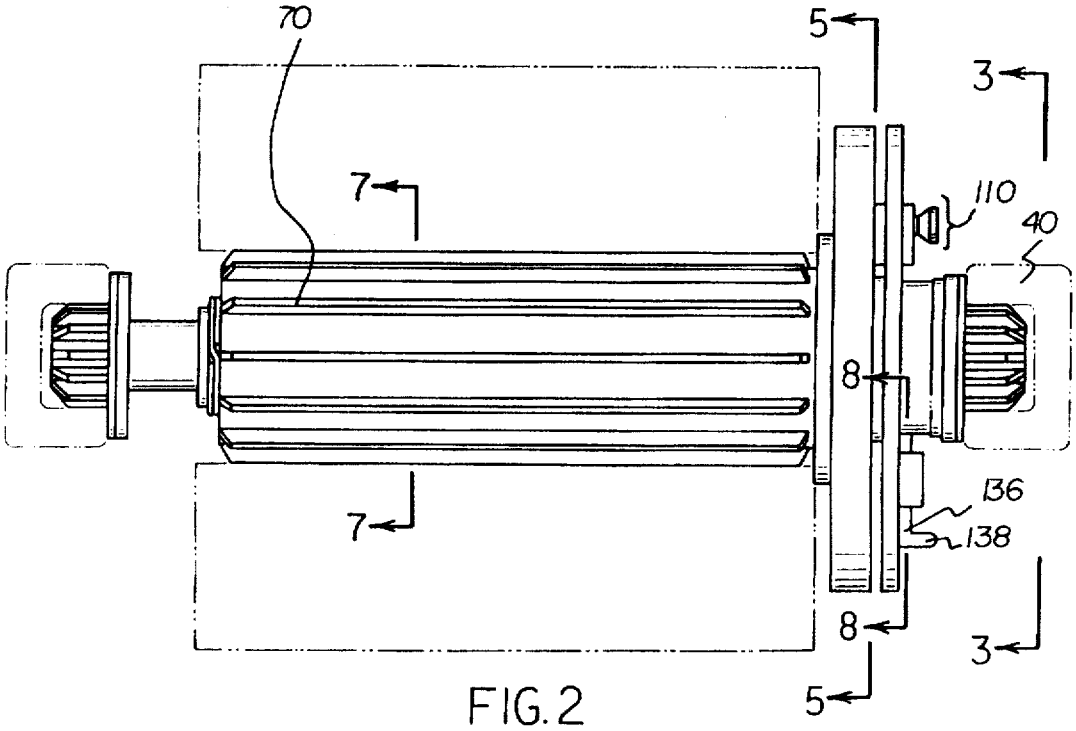
FIG. 2 is a side-elevational view of the preferred embodiment of the present invention.
Figure 6:
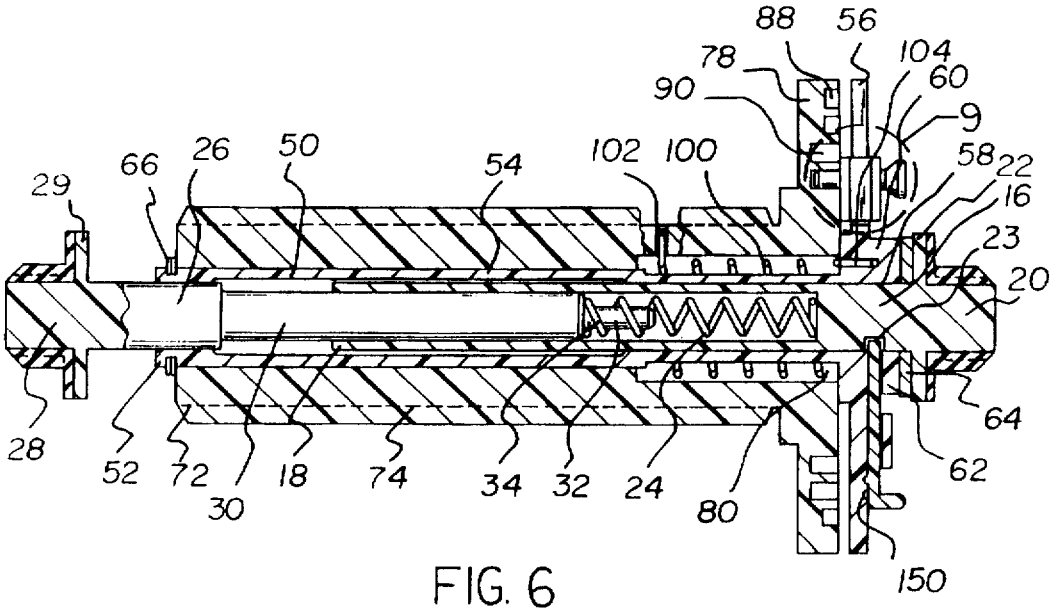
FIG. 6 is a cross-sectional view of the present invention taken along the line 6—6 of FIG. 3.
Figure 7:
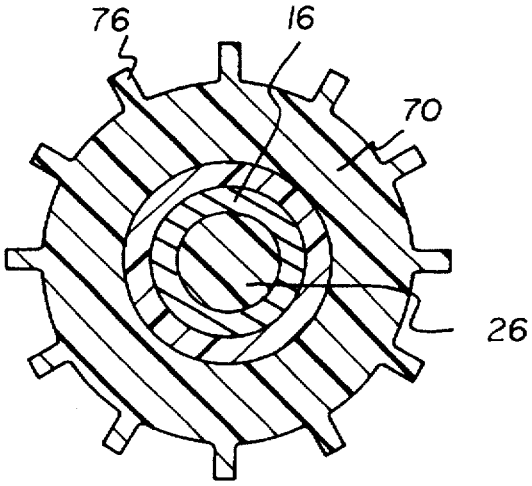
FIG. 7 is a cross-sectional view of the present invention taken along the line 7—7 of FIG. 2.
Figure 8:
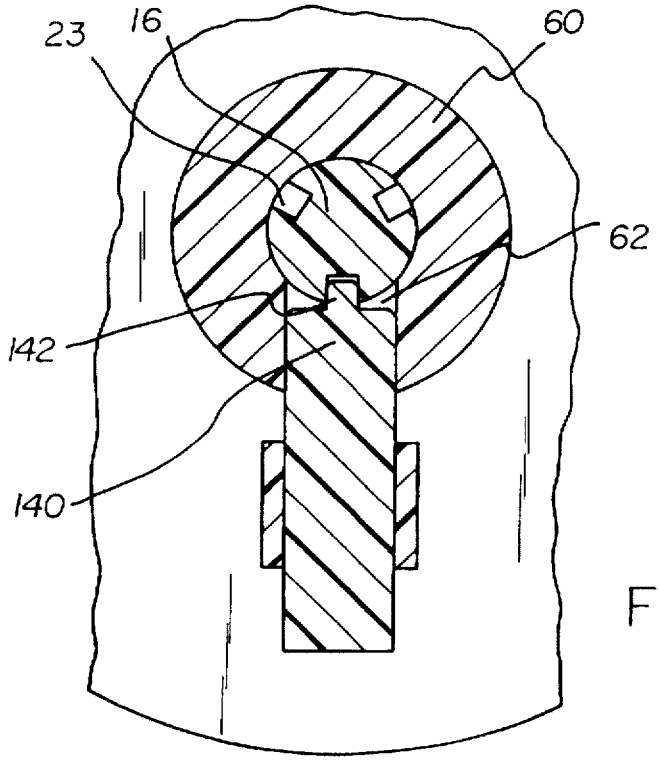
FIG. 8 is a cross-sectional view of the present invention taken along the line 8—8 of FIG. 2.
Figure 9:
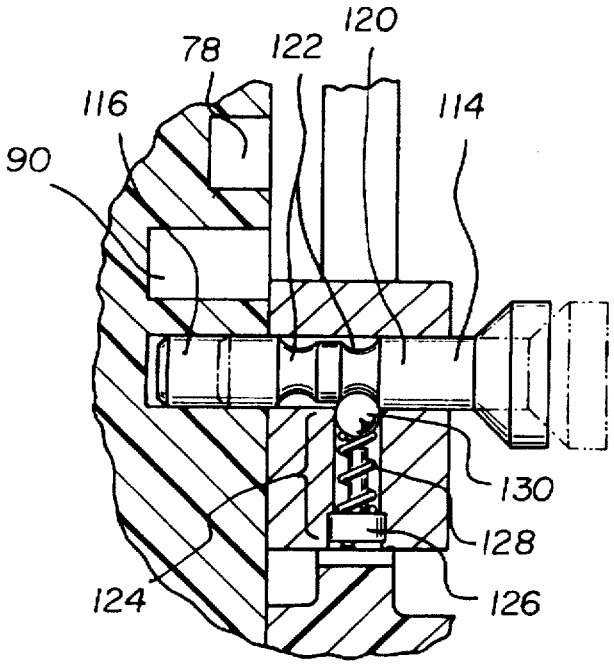
FIG. 9 is a detail view of the coupling of the pin mechanism with the outer sleeve as previously shown in FIG. 6.

With reference now to the drawings, and in particular, to FIG. 1 thereof, the preferred embodiment of the new and improved toilet paper holder and disbursement mechanism embodying the principles and concepts of the present invention and generally designated by the reference number 10 will be described.

The preferred embodiment of the present invention is comprised of a plurality of components. In their broadest context, such components include a rod, inner sleeve, outer sleeve, pin mechanism, latch, and associated springs. Such components are individually configured and correlated with respect to each other to allow for a set length of toilet paper to be disbursed from a tubular roll of toilet paper 12. The present invention thereby allows for disbursing a manually-selected amount of toilet paper based on consumption criteria or roll diameter.

Specifically, the present invention includes a spring-loaded elongated rod 14. The rod has an elongated tubular rigid first member 16. The first member has an open inboard end 18 and an exterior free outboard end 20 with a disk-shaped flange 22 extended outwards therefrom. In addition, the first member includes a rectangular notch 23 that is formed thereon at a location intermediate the ends 16, 18. A helical first spring 24 is disposed within the first member and in axial alignment therewith. The rod includes a cylindrical rigid solid elongated tubular second member 26. The second member 26 is slidably inserted within the first member in contact and in axial alignment therewith. The second member has a closed free outboard end 28 with a disk-shaped flange 29 extended radially outwards therefrom. The second member also has a closed and tapered inboard end 30 formed of two cylindrical sections and is terminated at an axially aligned pin 32. Pin 32 is engaged with an end 34 of the helical first spring 24. In this configuration, the first spring urges the members 16, 26 outward.

Each free end 16, 18 is terminated at a cap 36. The cap has a plurality of longitudinal rubber fins 38 extending radially outwards therefrom. Each cap is adapted to be fixedly secured to an external mounting bracket 40 with the fins used for gripping to thereby hold the rod in a fixed position for use.

Also provided is an elongated rigid inner sleeve 50. The inner sleeve is disposed about and in contact with the rod assembly. Furthermore, the inner sleeve is axially aligned with the rod and rotatable with respect thereto. The inner sleeve has an open end 52, a generally tubular inner intermediate portion 54, and a disk-shaped end portion 56 with a central opening 58. The end portion 56 is positioned in a plane substantially perpendicular to the inner intermediate portion 54. In addition, an axially aligned and integral flange 60 extends outwards from the end portion 56. A rectangular notch 62 is disposed on the flange and is alignable with the notch 23 on the first member 16 of the rod assembly. A washer 64 is coupled around the first member 16 in facing contact with the flange 60 of the inner sleeve and the flange 22 of the first member. The sleeve is held fixedly in place via an O-ring 66.

Also included is an elongated outer sleeve 70. The outer sleeve 70 is disposed about and in contact with the inner intermediate portion 54 of the inner sleeve. The outer sleeve is axially aligned with the inner sleeve and is rotatable with respect thereto. The outer sleeve has an open end 72, and a generally tubular outer intermediate portion 74. The outer intermediate portion 74 has a plurality of longitudinal rubber fins 76 extended radially outwards therefrom. The fins in combination are adapted for maintaining a grip on an interior surface of an unillustrated tube of the roll of toilet paper 12. In addition, the outer sleeve includes a disk-shaped end portion 78 with a central opening 80. The end portion 78 is positioned in a plane substantially perpendicular to the outer intermediate portion 74 at the location in juxtaposition to the end portion 56 of the inner sleeve. The end portion 56 of the inner sleeve also has a radial groove 82 formed thereon and a flat smooth exterior surface 84 of the end portion 78 having a helical groove 86. Groove 86 is formed of three turns and is axially aligned with the rod assembly 14 and inner sleeve 50. An outer one and one-half turns 88 of the groove has a fixed depth and an inner one and one-half turns 90 of the groove has a set depth that is greater than that of the outer one and one-half turns.

A second helical spring 100 is disposed about the inner sleeve 50 between the intermediate portion 54 and the outer intermediate portion 74 of the outer sleeve. The second helical spring has an inboard end 102 that is coupled to the outer sleeve and an outboard end 104 that is coupled to the end portion of the inner sleeve. The second spring urges the outer sleeve 70 to a fixed rest position relative to the inner sleeve when the outer sleeve is axially rotated and then released such as when toilet paper is payed out from the toilet paper roll.

An adjustable pin mechanism 110 is provided. The pin mechanism has a radially adjustable clamp 112 that is slidably secured within the radial groove 82 on the end portion of the inner sleeve. The pin mechanism includes a selector pin 114 coupled to the clamp 112. The selector pin has a free end 116 that is removably securable within the helical groove 86 on the end portion 78 of the outer sleeve. The selector pin has a head end 118 that allows a user a firm grip. The selector pin also has an intermediate portion 120 located between the free end 116 and the head end 118. The intermediate portion 120 has two circumferential and adjacently positioned and concave tapered portions 122 formed thereon. A spring-loaded detent 124 is also included. The detent 124 is formed of a ball stop 126, a ball spring 128 disposed about a portion of the ball stop, and a detent ball 130 in contact with an end of the ball spring. The selector pin has a reduced diameter between the tapered portions 122. After assembly, the detent ball has clearance over the reduced part of the selector pin that is located between the portions 122. The ball stop prevents clearance of the other elongated portions of the selector pin over the ball. The ball stop is coupled to the end portion of the outer sleeve. The detent removably engages the intermediate portion of the selector pin 114. One of the tapered portions is engagable with the detent when the selector pin is set in one position to define a setting that allows the selector pin to travel only along the outer portion 78 of the helical groove. Thus, in this position, when the outer sleeve is axially rotated, the roll of toilet paper 12 can only be rotated approximately one and one-half revolutions. The other tapered portion is engagable with the detent when the selector pin is set in another position to define another setting that allows the selector pin to traverse along both the outer portion 70 and inner portion 90 of the helical groove. Thus, when the outer sleeve is axially rotated, the toilet paper roll 12 can then be rotated approximately three revolutions. Consequently, the later positions allows for a longer pay out of toilet paper for use than the former position.

Lastly, an adjustable latch 130 is slidably coupled to the exterior surface of the end portion of the inner sleeve along a radial line thereof with a clamp 132. The latch 130 is positioned at a location diametrically opposed the pin mechanism 110. The latch has an elongated handle 134 having an output end 136 with an extended portion 138. The handle allows a user a firm grip for manipulating the latch. The latch also has a free inner end 140 with a tapered portion 142. The tapered portion 142 of the free end is removably positionable within the notch 62 of the inner sleeve through notch 23 of the rod to define a first orientation to preclude free movement of the inner sleeve. In this position, the rotational movement of the roll of toilet paper is limited adjustment of the selector pin 114 within the groove as previously described. In addition, the free end of the latch is removable from the notches 23, 62 to define a second orientation to allow free axially rotatable movement of the inner sleeve and outer sleeve as a unit with respect to the rod assembly. In this position, the roll of toilet paper may be revolved freely to pay out as much toilet paper as desired by a user. The latch 130 is held in place by detents 150 removably securable in associated grooves formed on the end portion of the inner sleeve.

The rod of the present invention can be separated to allow for another roll of toilet paper to be loaded onto the intermediate portion of the outer sleeve for use. The pin mechanism can include a locking assembly to allow only an authorized person to manually adjust the amount of toilet paper that may be disbursed. Thus, a given disbursement length may be set in a public restroom or the like to preclude excessive use of toilet paper.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A toilet paper holder and disbursement mechanism for use with a roll of toilet paper for disbursing a manually selected amount of the toilet paper comprising, in combination:

a spring-loaded elongated rod having an elongated tubular first member with an open inboard end and an exterior free outboard end, a first helical spring disposed within the first member and in axial alignment therewith, a cylindrical elongated tubular second member slidably inserted within the first member in contact and in axial alignment therewith and having a closed free outboard end, a closed and tapered inboard end engaged with an end of the first spring wherein the first spring urges the members outwardly, and a notch disposed thereon at a location intermediate the outboard ends, and wherein each free end is terminated at a cap having a plurality of longitudinal fins extending radially outwards therefrom and with each cap adapted to be fixedly secured to an external mounting bracket to hold the rod in a fixed position for use;

an elongated inner sleeve disposed about and in contact with the rod and axially aligned therewith and rotatable with respect thereto, the inner sleeve having an open end, a generally tubular inner intermediate portion, a disk-shaped end portion with a central opening positioned in a plane perpendicular to the inner intermediate portion, an integral flange extending outwards from the end portion, and a notch disposed on the flange, and wherein the notch on the inner sleeve is alignable with the notch on the rod;

an elongated outer sleeve disposed about and in contact with the inner intermediate portion of the inner sleeve and axially aligned therewith and rotatable with respect thereto, the outer sleeve having an open end, a generally tubular outer intermediate portion with a plurality of longitudinal fins extending radially outwards therefrom and adapted for maintaining a grip on an interior surface of the roll of toilet paper, a disk-shaped end portion with a central opening positioned in a plane perpendicular to the outer intermediate portion at a location in juxtaposition to the end portion of the inner sleeve, the end portion of the inner sleeve further having a radial groove formed thereon and the end portion of the outer sleeve having an exterior surface with a helical groove of three turns formed thereon with portions of the grooves being axially aligned and wherein the helical groove is axially aligned with the rod and the inner sleeve and wherein an outer one and one-half turns of the groove have a fixed depth and an inner one and one-half turns of the groove have a depth greater than the outer one and one-half turns;

a second helical spring disposed about inner sleeve between the inner intermediate portion thereof and the outer intermediate portion of the outer sleeve and with the second spring having an inboard end coupled to the outer sleeve and an outboard end coupled to the end portion of the inner sleeve for rotatably urging the outer sleeve to a fixed rest position relative to the inner sleeve when the outer sleeve is axially rotated and then released;

an adjustable pin mechanism having with a radially adjustable clamp slidably secured within the radial groove on the end portion of the inner sleeve, a selector pin coupled to the clamp and having a free end removably securable within the helical groove on the end portion of the outer sleeve, a head end for allowing a user a firm grip, an intermediate portion therebetween having two circumferential and adjacently positioned tapered portions formed thereon, and a spring-loaded detent coupled to the end portion of the inner sleeve and removably engaging the intermediate portion of the selector pin, and wherein one of the tapered portions is engagable with the detent when the selector pin is set in one position to define a setting that allows the selector pin to travel only along the outer portion of the helical groove when the outer sleeve is axially rotated relative to the inner sleeve, and wherein the other tapered portion is engagable with the detent when the selector pin is set in another position to define another setting that allows the selector pin to traverse along both the outer portion and inner portion of the helical groove when the outer sleeve is axially rotated relative to the inner sleeve; and an adjustable latch slidably coupled to the exterior surface of the end portion of the inner sleeve along a radial line thereof at a position diametrically opposed to the pin mechanism, the latch having an elongated handle having an outer end and a free inner end and wherein the free end is removably positionable within the notch on the inner sleeve and notch on the rod in a first orientation to preclude free movement of the inner sleeve relative to the rod, and wherein the free end is removable from the notches in a second orientation to allow axially rotatable movement of the inner sleeve and outer sleeve as a unit with respect to the rod.

2. A toilet paper holder and disbursement mechanism for use with a roll of toilet paper comprising:

a spring-loaded elongated rod having spring-loaded ends that are adapted to be fixedly secured to an external mounting bracket;

an elongated inner sleeve disposed about the rod and axially aligned therewith and rotatable with respect thereto and having an extended end portion positioned in a plane that is substantially perpendicular to the rod;

an elongated outer sleeve having means for fixedly holding a roll of toilet paper thereon, the outer sleeve disposed about the inner sleeve and axially aligned therewith and rotatable with respect thereto and having a extended end portion positioned in a plane that is substantially perpendicular to the rod at a location adjacent to the end portion of the inner sleeve;

spring means coupled between the inner sleeve and outer sleeve for rotatably urging the outer sleeve to a fixed rest position relative to the inner sleeve when the outer sleeve is axially rotated and then released;

manually-adjustable payout means coupled between the end portion of the inner sleeve and end portion of the outer sleeve for limiting the rotational movement of the inner sleeve with respect to the outer sleeve; and engageable latch means coupled to the end portion of the inner sleeve for precluding free movement of the inner sleeve when the latch means is engaged with the rod and for allowing free movement of the inner sleeve when disengaged.

3. The toilet paper holder and disbursement mechanism as set forth in claim 2 wherein each free end of the rod is terminated at a cap having a plurality of fins extending radially outwards therefrom.

4. The toilet paper holder and disbursement mechanism as set forth in claim 2 wherein the outer sleeve has a plurality of fins extending radially outwards therefrom for gripping a roll of toilet paper.

5. The toilet paper holder and disbursement mechanism as set forth in claim 2 wherein the end portion of the outer sleeve has a helical groove of a number of turns formed thereon and wherein a portion of each turn has a different depth; and wherein the payout means includes a manually adjustable selector pin that is removably securable within the helical groove at a depth that allows the selector pin to travel only along selected portions of the helical groove when the outer sleeve is axially rotated.

* * * * *